US008336985B2

(12) United States Patent
Hokazono et al.

(10) Patent No.: US 8,336,985 B2
(45) Date of Patent: Dec. 25, 2012

(54) INK-JET RECORDING APPARATUS

(75) Inventors: Yutaka Hokazono, Ebina (JP); Yoshihiro Koyama, Yokohama (JP); Norio Sasaki, Chigasaki (JP); Shinji Toyoshima, Kawasaki (JP); Yukimichi Kimura, Kawasaki (JP); Toshiaki Yamaguchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 12/712,115

(22) Filed: Feb. 24, 2010

(65) Prior Publication Data

US 2010/0214346 A1 Aug. 26, 2010

(30) Foreign Application Priority Data

Feb. 26, 2009 (JP) ..... 2009-043547

(51) Int. Cl.
*B41J 29/393* (2006.01)
*B41J 2/165* (2006.01)
*B41J 2/175* (2006.01)

(52) U.S. Cl. ..... 347/19; 347/30; 347/85

(58) Field of Classification Search ..... None
See application file for complete search history.

(56) References Cited

U.S. PATENT DOCUMENTS

| | | | | |
|---|---|---|---|---|
| 4,959,660 | A * | 9/1990 | Suzuki et al. | 347/34 |
| 7,419,238 | B2 * | 9/2008 | Yoshida | 347/19 |
| 2004/0113977 | A1 * | 6/2004 | Esaki et al. | 347/42 |
| 2005/0093919 | A1 * | 5/2005 | Takatsuka et al. | 347/30 |

FOREIGN PATENT DOCUMENTS

JP 2005-205650 A 8/2005

* cited by examiner

*Primary Examiner* — Stephen Meier
*Assistant Examiner* — Alexander C Witkowski
(74) *Attorney, Agent, or Firm* — Canon USA Inc. IP Division

(57) ABSTRACT

An ink-jet recording apparatus includes a platen provided with a suction-collection section which sucks in and collects ink discharged deviating from an end portion of recording medium. The ink-jet recording apparatus includes a suction force generation unit for collecting ink configured to enable the suction collection section to generate a suction force, a collection flow path connecting the suction collection section to the suction force generation unit for collection, and a flow path control unit configured to vary an sectional area of the collection flow path. The sectional area of the collection flow path is varied according to an image forming time or a type of the recording medium.

21 Claims, 13 Drawing Sheets

FIG. 6A

WHEN SHUTTER UNIT 12 IS NOT USED

| | NUMBER OF PATHS | | |
|---|---|---|---|
| | 4 | 8 | 12 |
| UNEVEN COCKLING | GOOD | ← → | NO GOOD |
| QUALITY OF END PORTION OF IMAGE | NO GOOD | ← → | GOOD |

FIG. 6B

WHEN SHUTTER UNIT 12 IS USED

201

| | NUMBER OF PATHS | | |
|---|---|---|---|
| | 4 | 8 | 12 |
| UNEVEN COCKLING | GOOD | ← → | GOOD |
| QUALITY OF END PORTION OF IMAGE | GOOD | ← → | GOOD |
| FLOWING PATH OPENING AREA | 1/4 OPEN | ← → | 3/4 OPEN |

202

FIG. 6C

FLOWING PATH OPENING AREA

| |
|---|
| FULLY CLOSED |
| 3/4 OPEN |
| 2/4 OPEN |
| 1/4 OPEN |
| FULLY CLOSED |

FIG. 6D

IMAGE QUALITY

| |
|---|
| GOOD |
| SLIGHTLY GOOD |
| |
| SLIGHTLY NO-GOOD |
| NO GOOD |

FIG. 7

| WIDTH OF RECORDING MEDIA (inch) | SHUTTER OPENING AREA |
|---|---|
| 17 | 1/4 ↕ |
| 24 | 2/4 ↕ |
| 36 | 3/4 ↕ |

* AN INK ABSORPTION LAYER IS APPLIED ON A RECORDING MEDIUM.

FIG. 9

| TYPE OF RECORDING MEDIUM | SHUTTER OPENING AREA |
|---|---|
| PAPER INCLUDING RESIN LAYER AND INK ABSORPTION LAYER | 1/4 |
| PAPER INCLUDING INK ABSORPTION LAYER | 2/4 |
| PAPER INCLUDING NO LAYER | 3/4 |

FIG. 10A

WHEN PAPER INCLUDES NO LAYER

| | APPLICATION RANGE | | NUMBER OF PATHS | | |
|---|---|---|---|---|---|
| | 2 | 4 | | | 16 |
| UNEVEN COCKLING | GOOD ↔ | GOOD | | | |
| QUALITY OF END PORTION OF IMAGE | GOOD ↔ | GOOD | | | |
| FLOWING PATH OPENING AREA | 1/4 OPEN ↔ | 1/4 OPEN | | | |

FIG. 10B

WHEN PAPER INCLUDES RESIN LAYER AND INK ABSORPTION LAYER

| | | APPLICATION RANGE | | |
|---|---|---|---|---|
| | | NUMBER OF PATHS | | |
| | 2 | 4 | | 16 |
| UNEVEN COCKLING | | GOOD ↔ | | GOOD |
| QUALITY OF END PORTION OF IMAGE | | GOOD ↔ | | BEST |
| FLOWING PATH OPENING AREA | | 1/4 OPEN ↔ | | 2/4 OPEN |

FIG. 10C

WHEN PAPER INCLUDES INK ABSORPTION LAYER

| | | APPLICATION RANGE | | |
|---|---|---|---|---|
| | | NUMBER OF PATHS | | |
| | 2 | 4 | | 16 |
| UNEVEN COCKLING | | GOOD ↔ | | GOOD |
| QUALITY OF END PORTION OF IMAGE | | GOOD ↔ | | GOOD |
| FLOWING PATH OPENING AREA | | 1/4 OPEN ↔ | | 3/4 OPEN |

INK-JET RECORDING APPARATUS

BACKGROUND OF THE INVENTION

1. Field of the Invention

The present invention relates to an ink-jet recording apparatus which performs recording by discharging ink from a recording head to recording medium supported on a platen.

2. Description of the Related Art

As a recording apparatus including a printer, a copy machine and a facsimile which records an image on the recording medium based on image information, an ink-jet recording apparatus is used which discharges ink from a recording head to the recording medium to perform recording. It is essential for the ink-jet recording apparatus to keep constant a gap between the recording head and the recording medium in order to keep high recording image quality since the recording is performed by discharging ink droplets.

If the recording medium of a sheet type such as a sheet of paper is uplifted, the recording head can come into contact with the recording medium to deteriorate or damage image quality. As one method for solving this problem, a platen for attracting a rear surface of the recording medium onto a conveyance surface of the platen by applying a suction force is discussed. Such a platen varies a force attracting the platen depending on characteristics of the recording medium such as stiffness and quality of a material, and further curling which varies depending on ambient humidity.

Normal printing is performed using a margin provided at a surrounding area of the recording medium. However, marginless printing may be also performed. In the marginless printing, the ink discharged from an end edge of the recording media adheres to the platen and then adheres to the recording media again to cause ink spots. Therefore, a marginless recessed section for receiving the ink is provided at a portion of the platen corresponding to the end edge of the recording medium to prevent the ink from adhering to the conveyance surface of the platen and further to prevent generation of the ink spots on the recording medium.

This marginless recessed section is arranged at a plurality of places depending on a size of the recording medium. In such a structure, since a flying length of the ink discharged outside the recording medium up to an impact position becomes long, a part of the ink cannot impact onto the recording medium and becomes floating mist. The mist may contaminate the conveyance surface of the platen, or come around and adhere to a rear surface of the recording medium to cause the ink spots. Therefore, it is discussed that the platen of an attraction type sucks in and collects the ink mist generated in a vicinity of the marginless recessed section by applying a suction force also to the marginless recessed sections.

In the platen of this type, if a single suction force generation unit such as a suction fan simultaneously performs attraction of the recording medium and suction at a suction collection section (marginless recessed section), when an attraction force is varied according to a type of the recording medium, a suction wind velocity generated in the suction collection section is also varied. Accordingly, when the suction wind velocity is low at the suction collection section, the floating mist can come around and adhere to the rear surface of the recording medium to cause the ink spots. When the suction wind velocity is high, the ink which otherwise should impact on a vicinity of an end portion of the recording medium is flown over to an outside of the recording medium to deteriorate the image quality.

Thus, it is demanded that, while the recording medium is attracted by the appropriate suction force, the suction force having a desired suction wind velocity is applied into the suction collection section outside the recording medium. In order to meet this demand, Japanese Patent Application Laid-Open No. 2005-205650 discusses a structure in which the suction force is applied by a dedicated suction force generation unit to the suction-collection section outside the recording medium.

However, if the suction wind velocity is decreased at the suction-collection section outside the recording medium, the suction force at an inner suction-collection section covered with the recording medium becomes insufficient. More specifically, the recording medium into which the ink infiltrates gets wet and swollen, and starts to become extended (cockling). Since the extension is concentrated on the inner suction-collection section of the recording medium having a weak suction force, the recording medium is uplifted at the inner suction-collection section in a vertical direction.

If the recording medium is uplifted, the impacting accuracy of the ink is decreased to deteriorate the image quality, and the recording medium may come into contact with the recording head (which is referred to as uneven cockling). On the other hand, if the suction force at the inner suction collection section covered with the recording medium is increased, the suction wind velocity at the suction-collection section outside the recording medium is also increased. Thus, the ink which otherwise should impact on the vicinity of the end portion of the recording medium is flown away by the suction force, thereby deteriorating the image quality.

SUMMARY OF THE INVENTION

The present invention is directed to prevent deterioration of image quality due to an insufficient suction-force at a suction-collection section for collecting discharged ink outside recording medium. Further, the present invention is directed to an ink-jet recording apparatus capable of preventing the deterioration of the image quality caused by an excessively high wind velocity at the suction-collection section outside the recording medium.

According to an aspect of the present invention, an ink-jet recording apparatus which performs recording by discharging ink from a recording head to recording medium supported on a platen includes a suction-collection section which is provided at the platen and configured to suck in and collect the ink discharged outside the recording medium, a suction force generation unit for collection configured to enable the suction collection section to generate a suction force, a collection flow path connecting the suction collection section to the suction force generation unit for collection, and a flow path control unit configured to vary an sectional area of the collection flow path. The sectional area is varied according to an image forming time and a type of the recording medium.

According to another aspect of the present invention, an ink-jet recording apparatus which performs recording by discharging ink from a recording head to recording medium supported on a platen includes an attraction section which is provided at the platen and configured to attract and support the recording medium, a suction force generation unit for attraction configured to enable the attraction section to generate a suction force, an attraction flow path connecting the attraction section to the suction force generation unit for attraction, a suction collection section which is provided at the platen and configured to suck in and collect the ink discharged outside the recording medium, a collection flow path connecting the suction collection section to the attraction flow path, and a flow path control unit configured to vary an sectional area of the collection flow path. The sectional area is varied according to an image forming time and a type of the recording medium.

The present invention can prevent the deterioration of the image quality caused by an insufficient suction force at the suction collection section for collecting the ink discharged outside the recording medium. Further, the present invention provides the ink-jet recording apparatus capable of preventing the deterioration of the image quality caused by the excessively high wind velocity at the suction collection section outside the recording medium.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 6A, 6B, 6C and 6D are tables illustrating an exemplary embodiment in which an sectional area of an ink collecting flow path is varied according to an image forming time by the ink-jet recording apparatus of the present invention.

FIG. 7 is a table illustrating the exemplary embodiment in which the sectional area of the ink collecting flow path is varied according to an image forming time by the ink-jet recording apparatus of the present invention.

FIG. 9 is a table illustrating the exemplary embodiment in which the sectional area of the flow path for ink collection is varied according to the type of recording medium by the ink-jet recording apparatus of the present invention.

FIGS. 10A, 10B, and 10C are tables illustrating the exemplary embodiment in which the sectional area of the flow path for ink collection is varied according to the type of recording medium in the ink-jet recording apparatus of the present invention.

DESCRIPTION OF THE EMBODIMENTS

Figure 1:
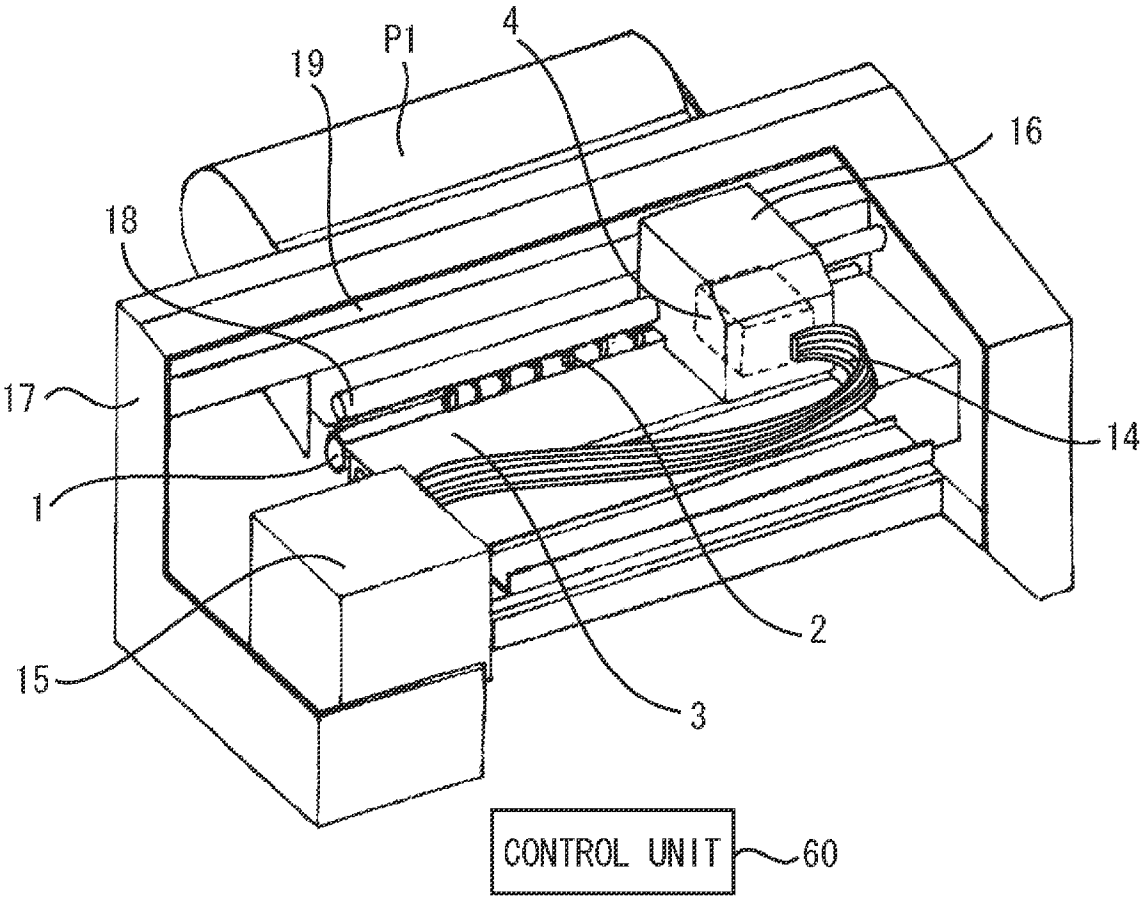
FIG. 1 is a perspective view of an ink-jet recording apparatus according to a first exemplary embodiment.

Various exemplary embodiments, features, and aspects of the invention will be described in detail below with reference to the drawings.

Same reference numerals indicate same parts or corresponding parts throughout figures.

Figure 2:
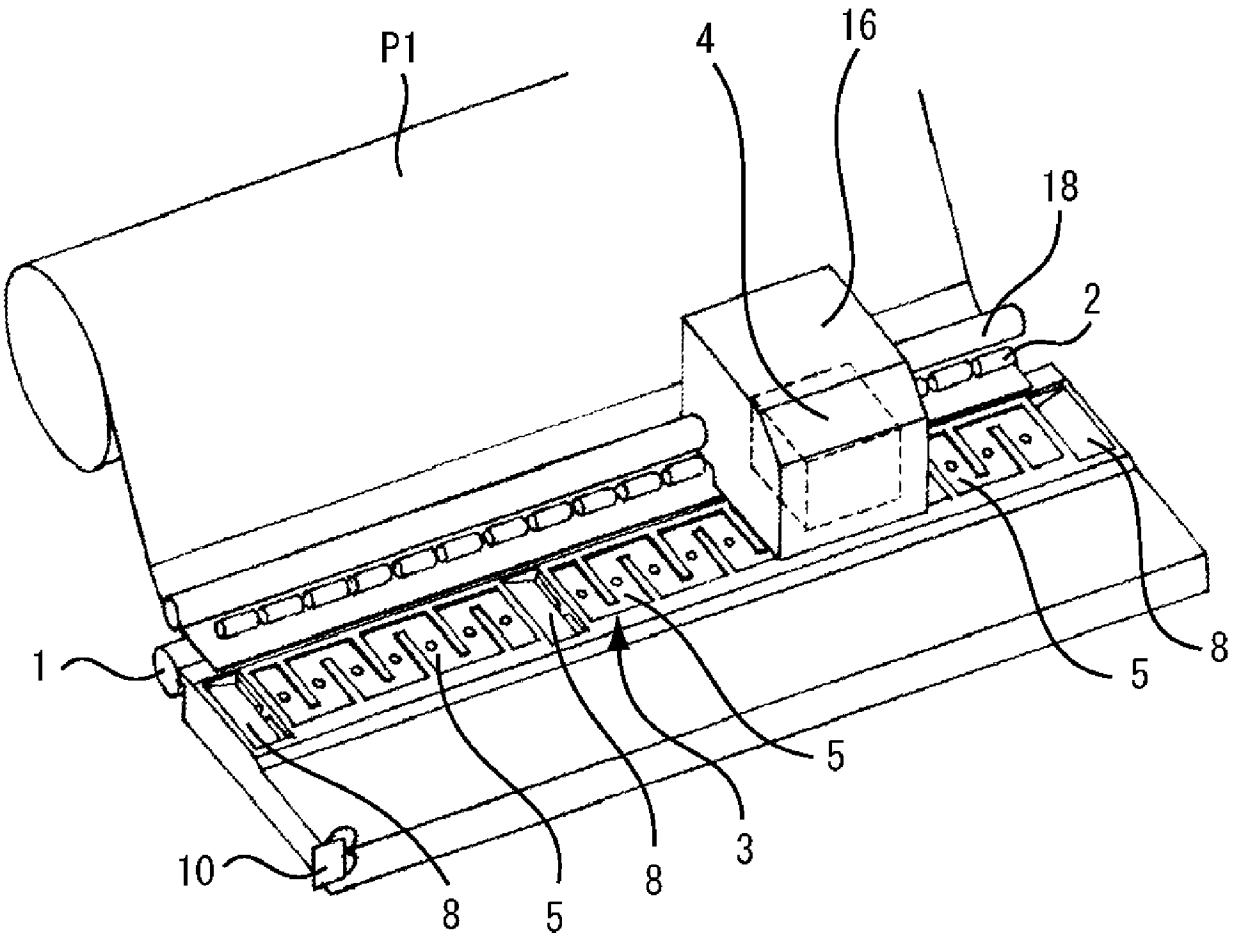
FIG. 2 is a perspective view of an essential part of the ink-jet recording apparatus according to the first exemplary embodiment.

FIG. 1 is a perspective view of an ink-jet recording apparatus according to a first exemplary embodiment. FIG. 2 is a perspective view of an essential part of the ink-jet recording apparatus according to the first exemplary embodiment. The ink-jet recording apparatus illustrated in FIGS. 1 and 2 is provided with a paper feed mechanism feeding a roll sheet, which is recording medium. In a path for conveying recording medium P1 released from the paper feed mechanism, a conveyance roller 1, a platen 3, and a cutter 10 are disposed in order.

A driven roller (pinch roller) 2 which gives a conveyance force is press-contacted to a conveyance roller 1. In a range of a platen 3, an image forming unit including a carriage 16 on which a recording head 4 is mounted and reciprocated, is disposed. Recording is performed on the recording medium P1 fed by the conveyance roller 1 while being supported on the platen 3, with ink discharged from a recording head 4 based on image information. The ink is supplied to the recording head 4 from an ink tank 15 through a flexible supply tube 14.

A carriage 16 is slidably supported by a guiding shaft 18 and a guiding rail 19 which are fixed to a frame of an apparatus body 17, and reciprocate driven via a belt transmission mechanism (not illustrated) by a motor (not illustrated). Recording one line by a movement of the recording head 4 and paper feeding at a predetermined pitch are alternately repeated to record one page. The recording medium P1 on which recording is performed is cut by the cutter 10 and discharged to a stacking unit outside the apparatus body. The cut recording medium (rolled sheet) is rewound to a stand-by position for next recording by a reverse rotation of the paper feed mechanism and the conveyance roller. When a cut sheet is used as the recording medium, a similar method for recording an image is performed and the cut sheet is discharged to the stacking unit such as a discharge tray.

The ink-jet recording apparatus is provided with a control unit 60 including a controller including a central processing unit (CPU), a memory, and an Input-Output (I/O) circuit. The control unit 60 controls an operation of a driving motor and various devices according to a control program previously stored in an inner memory. By this control unit 60, operations for feeding and conveying the recording medium are controlled. The recording head 4 is controlled based on the image information to record an image on the recording medium P1. Further, the control unit 60 controls a suction operation performed by negative pressure generation units 6 and 21 described below, a shutter unit 12 (shutter unit) as well as an operation and timing of the entire apparatus.

Figure 3:
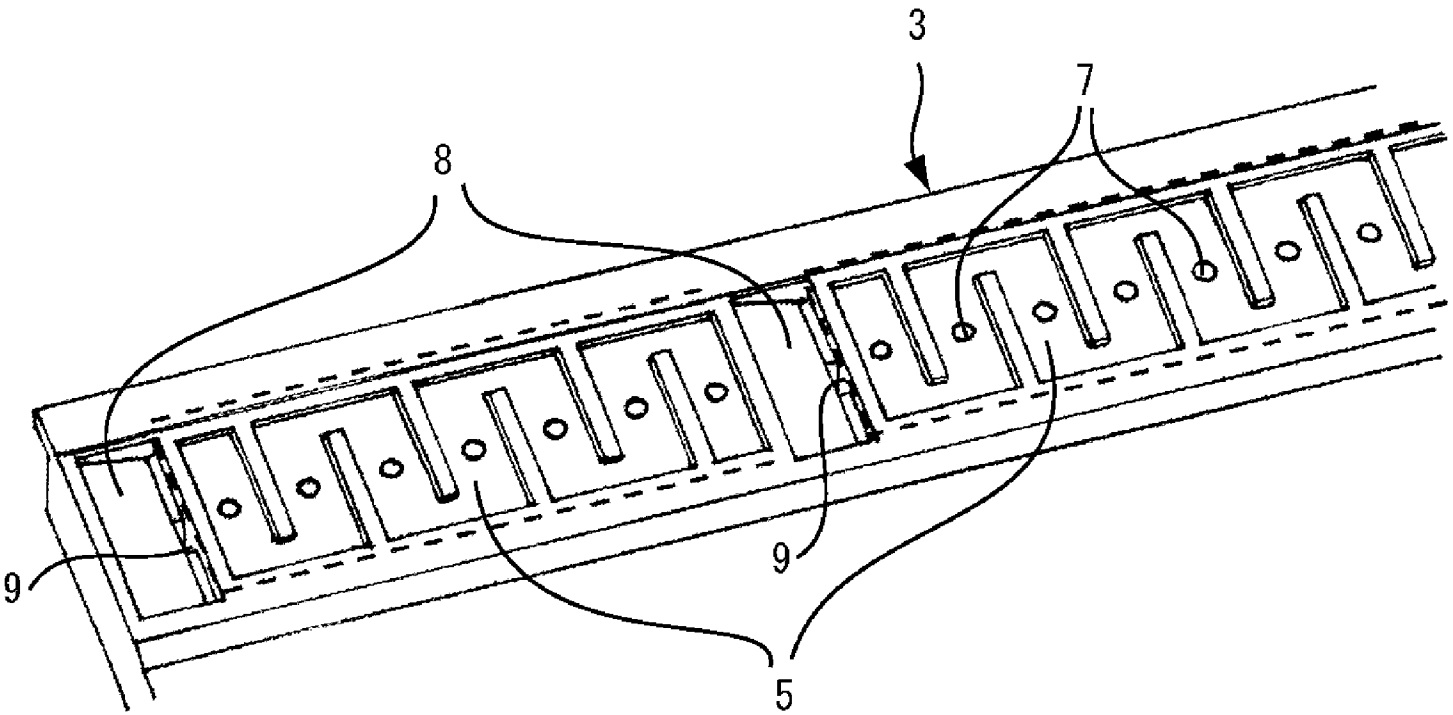
FIG. 3 is a perspective view of a platen of the ink-jet recording apparatus according to the first exemplary embodiment.
Figure 4:
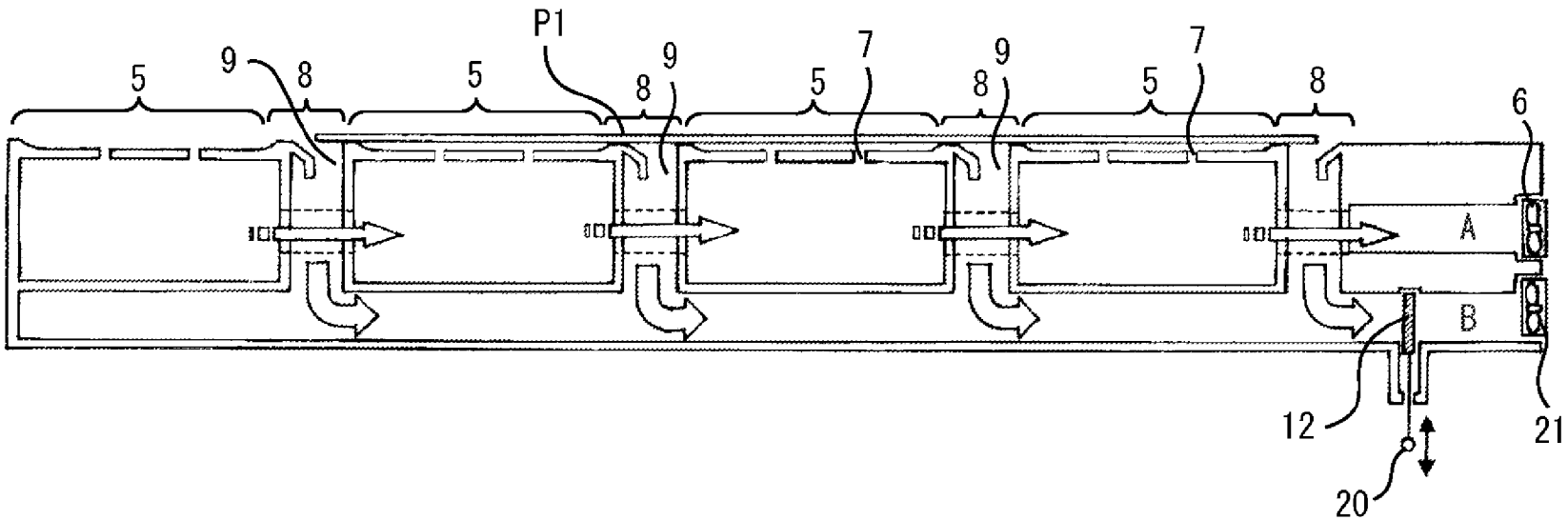
FIG. 4 is a cross-sectional view of the platen of the ink-jet recording apparatus according to the first exemplary embodiment.

FIG. 3 is a perspective view of the platen in the ink-jet recording apparatus according to the first exemplary embodiment. FIG. 4 is a cross-sectional view of the platen in the ink-jet recording apparatus according to the first exemplary embodiment. An attraction section 5 attracting and supporting the recording medium P1 of a sheet type such as a paper sheet is provided on the conveyance surface of the platen 3. The platen 3 is hollowed. A suction force generation unit 6 for attraction of the recording medium such as a suction fan which generates a suction force at the attraction section 5 is provided at one end portion of the platen 3. The attraction section 5 and the suction force generation unit 6 for attraction are connected with each other by the attraction flow path "A". Suction apertures 7 for preventing the recording medium from cockling and uplifting, by the suction force generated by the suction force generation unit 6 for attraction, are formed in a predetermined alignment on the attraction section 5. As the suction force generation unit 6 for attraction, for example, a space saving sirocco fan capable of realizing a powerful suction force is used.

A suction-collection section 8 for sucking in and collecting the ink discharged outside the end edge of the recording medium P1 is provided on the conveyance surface of the platen 3. The suction force generation unit 21 for collecting the ink such as a suction fan which generates the suction force at the suction-collection section 8 is provided at one end portion of the platen 3. The suction-collection sections 8 are provided at a plurality of places corresponding to the end edges of the recording medium having different sizes.

Each suction-collection section 8 is connected to the suction force generation unit 21 for collecting ink through a collection flow path "B". The suction force generation unit 21 for collecting ink generates a negative pressure and keeps an inside of the collection flow path "B" at the negative pressure. Each suction-collection section 8 is formed to stride between right and left end edges of the recording medium P1 of each size, and receives and collects the ink discarded (discharged) outside the end edges when the marginless printing is performed.

A suction aperture 9 for sucking in and collecting the discarded ink and floating mist is provided inside each suction-collection section 8. A bottom surface of the suction-collection section 8 is a slope which the adhering ink flows down to the suction aperture 9 with gravity. The suction force generation unit 21 for collecting the ink keeps the inside of the collection flow path "B" at the negative pressure to flow the fluid including the discarded ink, the floating mist, and the air into the suction aperture 9.

The attraction section 5 is provided at a plurality of places on the conveyance surface and formed in a recessed surface section which is disposed slightly lower than the conveyance surface. Each attraction section 5 is formed of a plurality of suction apertures 7 in a predetermined alignment. Each suction aperture 7 is connected to the suction force generation unit 6 for attraction through an attraction flow path "A" via a closed space in the platen 3 and generates the suction force attracting the recording medium. At the suction aperture 9 of each suction collection section 8, the suction force is generated by the suction force generation unit 21 for collecting ink via the collection flow path "B". The suction force generation unit 6 for attraction operates at the number of rotations according to characteristics, for example, stiffness and a thickness of the recording medium P1 or a type of the recording medium. On the other hand, typically, the suction force generation unit 21 for collection is operated at the fixed number of rotations, however, the number of rotations may be changed as needed.

Thus, a shutter unit 12 is provided in the collection flow path "B" as a flow path control unit which can vary an sectional area of the flow path. In this embodiment, the shutter unit 12 of a manual type is used. A lever 20 which can be accessed from an outside of the recording apparatus is operated to vary (adjust) the sectional area of the collection flow path "B". The air sucked in by the suction force generation unit 6 for attraction and the suction force generation unit 21 for collection is discharged to the outside of the apparatus through a filter (not illustrated) . When the ink-jet recording apparatus according to the first exemplary embodiment records the image on the recording media, the sectional area of the collection flow path "B" is varied by the shutter unit 12 according to both or either of an image forming time until the image is completed, and a type of the recording medium on which the image is recorded.

With this arrangement, the suction force generated at the suction collection section 8 by the suction force generation unit 21 for collection is controlled. For example, when the recording medium easily deforms while the image is being formed, the suction force of the collection flow path "B" is strengthened. When the recording medium does not easily deform, the suction force of the collection flow path "B" is weakened. If the sectional area of the collection flow path "B" is varied by the shutter unit 12, the negative pressure in the collection flow path "B" leading to the suction aperture 9 is also varied, thereby varying a flowing amount of fluid flowing into the suction aperture 9. The shutter unit 12 serves as a flowing amount control unit and also a negative pressure control unit.

Figure 5:
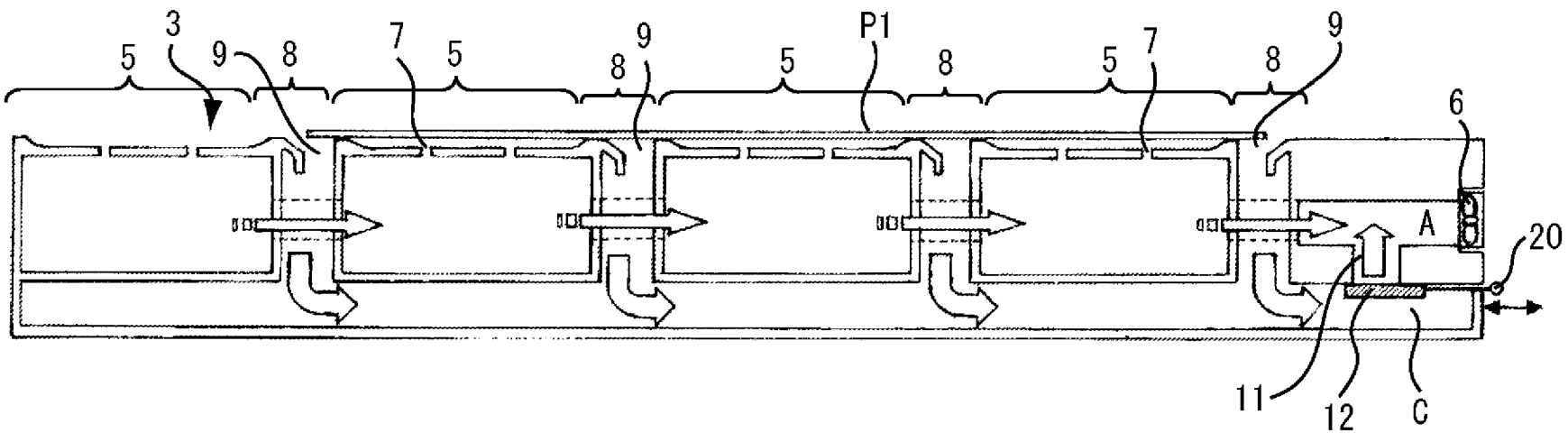
FIG. 5 is a cross sectional view of the platen of the ink-jet recording apparatus according to a second exemplary embodiment.

FIG. 5 is a cross-sectional view of the platen of the ink-jet recording apparatus according to the second exemplary embodiment. In the present exemplary embodiment, the suction force generation unit 21 for collecting ink used in the first exemplary embodiment is omitted, instead, and the suction force generation unit 6 for attracting a recording medium is used to generate the suction force at both of the attraction section 5 and the suction collection section 8. More specifically, instead of the collection flow path "B" connecting the suction collection section 8 to the suction force generation unit 21 for collection used in the first exemplary embodiment, a collection flow path "C" merging into the attraction flow path "A" is formed. A shutter unit 12 as a flow path control unit, which varies the sectional area of the collection flow path "C", is provided at a merging section 11 of the collection flow path "C" and the attraction flow path "A". As illustrated in FIG. 5, since the merging section 11 is formed in a vertical direction, the shutter unit 12 operates in a horizontal direction. The present exemplary embodiment has a different configuration from that of the first exemplary embodiment in those points described above, but have a similar configuration except for those points.

The second exemplary embodiment includes the attraction section 5 provided with the platen 3 attracting and supporting the recording medium, the suction force generation unit 6 for attraction, which generates the suction force at the attraction section 5, and the attraction flow path "A" connecting the attraction section 5 to the suction force generation unit 6 for attraction. In order to suck in and collect the ink discarded outside the recording medium, the second exemplary embodiment further includes the suction collection section 8 provided in the platen 3 and the collection flow path "C" connecting the suction collection section 8 to the attraction flow path "A" via the merging section 11.

Furthermore, the second exemplary embodiment includes the shutter unit 12 provided at the merging section 11 to vary the sectional area of the collection flow path "C". The air sucked in by the suction force generation unit 6 for attraction (air sucked in from the attraction section 5 and the suction collection section 8) is discharged to the outside of the apparatus through the filter (not illustrated). In the ink-jet recording apparatus according to the second exemplary embodiment, when the image is recorded on the recording medium, the sectional area of the collection flow path "C" is varied by the shutter unit 12 according to both or either of the image forming time until the image is completed, and the type of the recording medium.

This arrangement described above controls the suction force generated at the suction collection section 8 by the suction force generation unit 6 for attraction. For example, when the recording medium easily deforms while the image is being formed, the suction force of the collection flow path "B" is strengthened. When the recording medium is not easily to be deformed, the suction force of the collection flow path "B" is weakened.

In the first and second exemplary embodiments described above, the suction force generation unit 6 for attraction is operated at the number of rotations according to the characteristics of the recording medium P1. For example, when the thick recording medium has the high stiffness and the strong curling, the recording medium is strongly attracted and supported at the large number of rotations suppressing uplift. On the other hand, when the thin recording medium having the low stiffness is conveyed, more specifically, when the recording medium easily deforms while the image is being formed, the recording medium is weakly attracted and supported at the small number of rotations in order to improve a conveyance accuracy.

A shutter position of the shutter unit 12 is automatically detected by a position detection unit (not illustrated). Prior to starting image recording, a user is instructed to operate the shutter unit 12 to locate it at a shutter position corresponding to the predetermined recording condition. The user moves the shutter unit 12 to an appropriate position using the lever 20 and keeps this state during a recording operation. On the other hand, the suction force generation unit 21 for collection used in the first exemplary embodiment can be operated at the fixed number of rotations and adjusts the suction wind velocity and the suction force at the suction collection section 8 by adjusting the sectional area of the shutter unit 12.

With reference to FIGS. 6A, 6B, 6C, 6D, 7, 8, 9, and 10, exemplary embodiments of various methods for controlling the shutter unit 12, which is the flow path control unit, will be described. The control methods according to the exemplary embodiments described above are applicable to the first and second exemplary embodiments.

FIGS. 6A, 6B, 6C and 6D are diagrams illustrating the first control method for varying the sectional area of the collection flow path according to the image forming time in the ink-jet recording apparatus of the present invention. FIG. 6A illustrates relationships among the image forming time of the recording medium, uneven cockling thereof, and quality of the image at the end portion thereof when the shutter unit 12 is not used. The image forming time is determined by the number of times of discharging and superimposing the ink onto a certain portion of the recording medium until the image is completed.

The number of times of discharging and superimposing the ink on the recording medium will be described. Typically, the ink-jet recording apparatus completes the image by discharging and superimposing the ink onto a same portion of the recording medium. The reason for that is, although superimposing of the ink takes time until the image is completed, the image quality is improved. For example, the image is more improved when the ink is discharged and superimposed sixteen times than when the ink is discharged only once.

The less a number of times the ink is discharged and superimposed, the shorter the image forming time becomes. Thus, the number of times of superimposing the ink varies according to a purpose for recording the image. An amount of the ink to be discharged onto the recording medium to generate one image is constant and has almost nothing to do with the number of times of superimposing the ink. More specifically, when the ink is superimposed at the same portion sixteen times, one sixteenth of an amount of the ink which is discharged once for generating the image, is discharged every time. Hereafter, the number of times of superimposing the ink onto the recording medium is referred to as the number of paths (image forming time).

FIG. 6B illustrate relationships among the number of the paths (image forming time), uneven cockling of the recording medium (swelling or waving due to the infiltrated ink), and the quality of the image at the end portion thereof, in a case where the shutter unit 12 is used. In the present exemplary embodiment, the shutter unit 12 is controlled between "¼ OPEN" and "¾ OPEN" of the flow path sectional area. FIG. 6C indicates levels of the sectional area of the collection flow path (the collection flow path "B" in the first exemplary embodiment or the collection flow path "C" in the second exemplary embodiment). FIG. 6D indicates levels of the image quality.

The levels of the sectional areas of the collection flow paths "B" and "C" are classified into five, which are "FULLY OPEN", "¾ OPEN", "⅔ OPEN", "¼ OPEN", and "FULLY CLOSED". The levels of the image quality are classified into five, "GOOD" indicates the highest level, and "NOT GOOD" indicates the lowest level. According to the first and second exemplary embodiments, by varying the sectional areas of the flow paths using the shutter unit 12, which is the flow path control unit, a portion where the image quality is at the low level (not good) as indicated in the FIG. 6A can be improved as indicated by 201 and 202 in the FIG. 6B. In other words, a portion where the image quality is deteriorated by the uneven cockling due to the large number of paths, and a portion where the image quality is deteriorated at the end portion of the recording medium due to the small number of paths, are improved.

More specifically, when the number of the paths is four or less, the sectional areas of the collection flow paths "B" and "C" are operated to be "¼ OPEN" using the shutter unit 12 to decrease the suction wind velocity at the suction-collection section 8 outside the recording medium. With this operation, when the marginless recording is performed, the ink which is to impact on the end portion of the recording medium can be prevented from flowing outside the recording medium. Thus, the deterioration of the quality of the image at the end portion thereof due to ink flow can be improved as indicated by 202 in FIG. 6B.

On the other hand, when the number of the paths are twelve or more, the sectional areas of the collection flow paths "B" and "C" are operated to be "¾ OPEN" using the shutter unit 12. With this operation, the suction force at the suction-collection section 8 inside the recording medium (covered with the recording medium) becomes stronger, and the uneven cockling of the recording medium supported on the platen is improved as indicated by 201 in FIG. 6B. When the number of the paths is around eight, the lever 20 is operated such that the sectional areas of the shutter unit 12 in the collection flow paths "B" and "C" are "⅔ OPEN".

Now, effects generated by varying the sectional areas of the collection flow paths "B" and "C" by using the shutter unit 12 as described above will be described. When the small number of the paths is used, since the image forming time until the image is completed is short, discharge of the ink is ended before the recording medium is uplifted by the cockling. Thus, the position where the ink impacts on the recording medium is scarcely deviated and the image quality is hardly deteriorated, for example, no uneven image will be generated.

However, since the ink is superimposed only a few times, the ink which should impact on the end portion of the recording medium, flows to the suction-collection section 8. This phenomenon is easily noticeable. Therefore, under a condition that the number of paths is small, the negative pressure at the suction-collection section 8 inside the recording medium and the suction wind velocity at the suction-collection section 8 outside the recording medium are decreased by narrowing the collection flow paths "B" and "C" using the shutter unit 12, which improves the quality of the image at the end portion thereof.

On the other hand, when the large number of paths are used, since the ink is superimposed many times until the image is completed, the ink which should impact on the end portion of the recording medium, flows to the suction-collection section 8. This phenomenon is not easily noticeable. However, since it takes longer to perform image forming, the ink is continuously discharged and superimposed even after the recording medium starts to be uplifted due to the cockling (swelling or waving due to the infiltrated ink), the uneven image generated by the deviated impacting of the ink is obviously observable.

Accordingly, under a condition that the number of paths is large, the suction wind velocity at the suction-collection section 8 outside the recording medium and the negative pressure of the suction-collection section 8 inside the recording medium are increased by widening the collection flow paths "B" and "C" using the shutter unit 12. Thus, the uneven cackling generated by the ink which infiltrates into the recording medium can be decreased and the image quality is improved. According to the control method described above, the sectional areas of the collection flow paths "B" and "C" are varied using the shutter unit 12 to keep the high image quality.

FIG. 7 is a diagram illustrating a control method for varying the image areas of the collection flow paths "B" and "C" according to the image forming time. The control method illustrated in FIG. 7 determines the image forming time by a width of the recording medium. In FIG. 7, each of the recording mediums has a width of 36 inches, 24 inches, and 17 inches which is covered with the ink suction layer. According to the control method, when the recording medium has the width of 36 inches, the sectional areas of the collection flow paths "B" and "C" are operated to be "¾ OPEN" using the shutter unit 12. When the width of 24 inches, the sectional areas are operated to be "⅔ OPEN". Further, when the recording medium has the width of 17 inches or less, since the cockling is hardly generated, the sectional areas are operated to be "¼ OPEN" to decrease the suction wind velocity, so that deviation of the impacting position due to the ink flow at the end portion of the recording medium is prevented.

The smaller the width of the recording medium is, the more hardly the cockling is generated. The reason for that will be described below. When the width of 36 inches is compared with that of 17 inches, if the recording medium having the width of 36 inches is used, a moving distance of the recording head 4 in a main scanning direction is long corresponding to the width of 36 inches. On the other hand, when the recording medium having the width of 17 inches is used, the moving distance of the recording head 4 can be short.

Therefore, when the width of the recording medium is smaller , for example, 17 inches, the image forming time until the image is completed also becomes shorter, so that the cockling is hardly generated. As illustrated in FIG. 7, also by varying the sectional areas of the collection flow paths "B" and "C" according to the image forming time determined by the width of the recording medium, a similar operation effect to that of the control method illustrated in FIG. 6 can be obtained, so that the high image quality can be kept.

Figure 8:
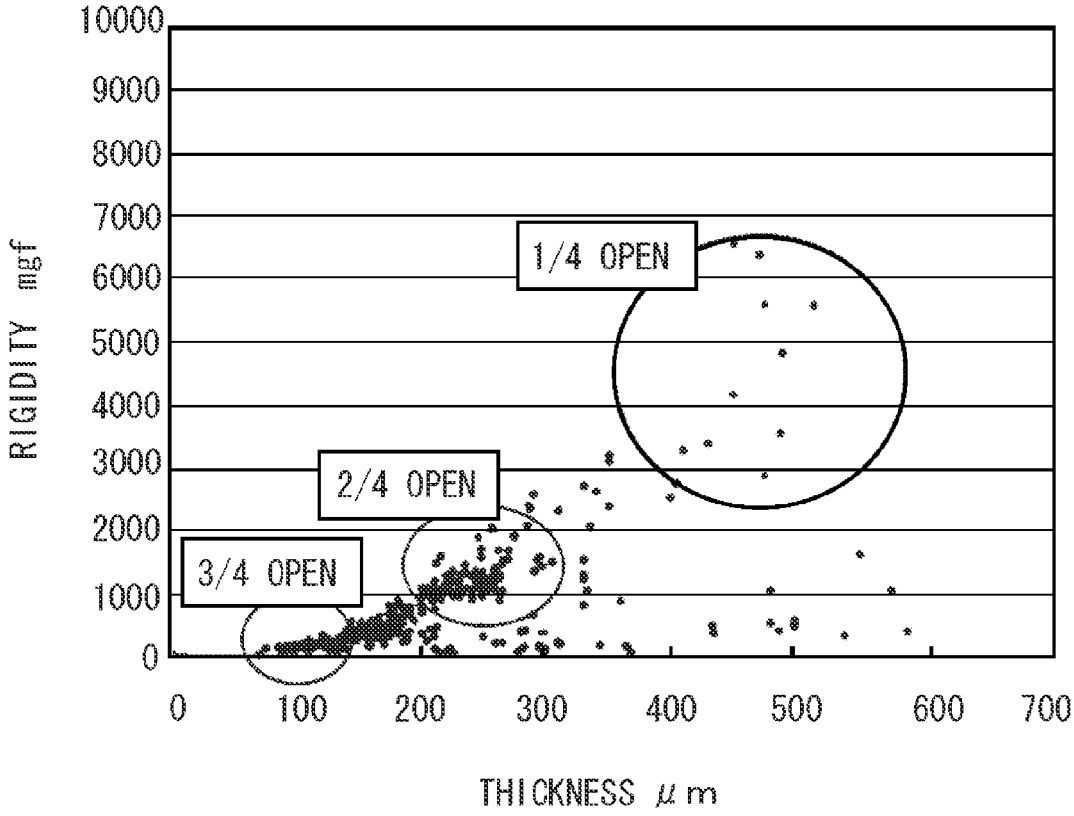
FIG. 8 is a graph illustrating an exemplary embodiment in which the sectional area of the ink collecting flow path is varied according to a type of recording medium by the ink-jet recording apparatus of the present invention.

FIG. 8 is a graph illustrating the control method for varying the sectional area of the collection flow path according to a type of the recording medium in the ink-jet recording apparatus of the present invention. According to the control method illustrated in FIG. 8, the type of the recording medium is determined by the stiffness and the thickness of the recording medium and whether the recording medium easily deforms while the image is being formed. Based on the type of the recording medium, FIG. 8 individually, specifically illustrates positional ranges of suitable sectional areas (opening levels) of the shutter unit 12 with respect to the thickness (pm) indicated along a horizontal axis and the stiffness (mgf) indicated along a vertical axis.

The larger the stiffness is, the larger the drag force against the cockling becomes. When the recording medium is thick, the drag force is increased even for the same stiffness. In the exemplary embodiment illustrated in FIG. 8, in a range where the stiffness is about 5000 mgf and the thickness is about 500 μm, since the drag force against the cackling is pretty large, the sectional area is operated to be "¼ OPEN" using the shutter unit 12 to decrease the suction force. The stiffness is measured by a Gurley type stiffness tester.

On the other hand, since the drag force against the cockling is weak within the range where the stiffness is about 500 mgf and the thickness is about 100 μm, the sectional areas is operated to be "¾ OPEN" using the shutter unit 12 to increase the suction force. Within the range where the stiffness is about 2000 mgf and the thickness is about 250 μm, which is the middle range, the uneven cackling is compared with the deviation of the ink impacting at the end portion of the recording medium to be measured and the sectional area is operated to be "⅔ OPEN" using the shutter unit 12. Since the stiffness of the recording medium greatly varies depending on an ambient temperature, in consideration of the variation, the sectional area needs to be changed.

FIG. 9 is a diagram illustrating the control method for varying the sectional area of the collection flow path according to the type of the recording medium in the ink-jet recording apparatus of the present invention. The control method illustrated in FIG. 9 determines the type of the recording medium according to material quality (including whether it can easily deform while the image is being formed) which covers the recording medium. For example, when glossy paper acquired by applying a resin layer onto pulp and then applying the ink suction layer onto the resin layer, is used, even if the ink is applied to the recording medium, the ink does not reach the pulp since the resin layer exists. Thus, the cockling is hardly generated. In this case, to prevent the ink from deviating when the ink impacts on the vicinity of the end portion of the recording medium, the sectional area (flow path sectional area) is operated to be "¼ OPEN" using the shutter unit 12 to decrease the suction force.

When non-applied paper in which a surface of the pulp is not covered with the ink suction layer and the resin layer is used as the recording medium, the cockling can be easily generated since the recording medium includes no ink suction layer nor the resin layer. Thus, in this case, to prevent the uneven cockling, the sectional area is operated to be "¾ OPEN" to increase the suction force. Further, when paper which is covered with the suction layer is used as the recording medium, the sectional area is operated to be "⅔ OPEN" since the cockling can be easily generated due to no resin layer.

FIGS. 10A, 10B, and 10C are diagrams illustrating the control methods for varying the sectional area of the collection flow path according to the type of the recording medium in the ink-jet recording apparatus of the present invention. The control method illustrated in FIGS. 10A, 10B, and 10C considers both of the type of the recording medium and the number of the paths (image forming time depending on the number of times of superimposing the ink) until the image is completed, and individually, specifically illustrates the suitable sectional area of the shutter unit 12. FIG. 10A illustrates a case where the non-applied paper is used as the recording medium. In this case, because of nature of the recording medium, even if the number of the paths is increased, great improvement of the image quality cannot be expected. Rather, instead of the image quality, speedy completion and low costs are expected. In such a point of the view, a range is limited to the small number of the paths and the sectional area is operated to be "¼ OPEN" using the shutter unit 12 to decrease the suction force even if the cockling can be easily generated. With such a flow path control, preventing the cockling and keeping the high quality of the image at the end portion of the recording medium can be both realized.

FIG. 10B illustrates the control when the glossy paper acquired by applying the resin layer to the pulp and then applying the ink suction layer to the resin layer is used. Since this control mostly targets a high quality image, the application range is set within the range having the large number of the paths. Accordingly, the cockling can be hardly generated for the material. The range is set to the range having the large number of the paths, the sectional area is operated to have a range of "¼ OPEN" to "¾ OPEN" by using the shutter unit 12 to comparatively decrease the suction force having such a flow path control. Accordingly, preventing the cockling and keeping the high quality of the image at the end portion of the recording medium can be both realized.

FIG. 10C illustrates the control when paper including the ink suction layer is used as the recording medium. In a case of such a recording medium, since the high quality image and reasonable costs are often targeted, the large number of the paths tends to be set. Further, since the recording medium includes no resin layer, the cockling can be easily generated. Thus, in this case, the sectional area is controlled to vary between "¼ OPEN" and "¾ OPEN" according to the number of the paths by using the shutter unit 12.

With such flow path control, preventing the cockling and keeping the high quality of the image at the end portion of the recording medium can be both realized. In each exemplary embodiment described above, the sectional areas of the collection flow paths "B" and "C" are varied according to either one of the image forming time and the type of the recording medium. However, the sectional areas may be varied according to both of the image forming time and the type of the recording medium.

Figure 11:
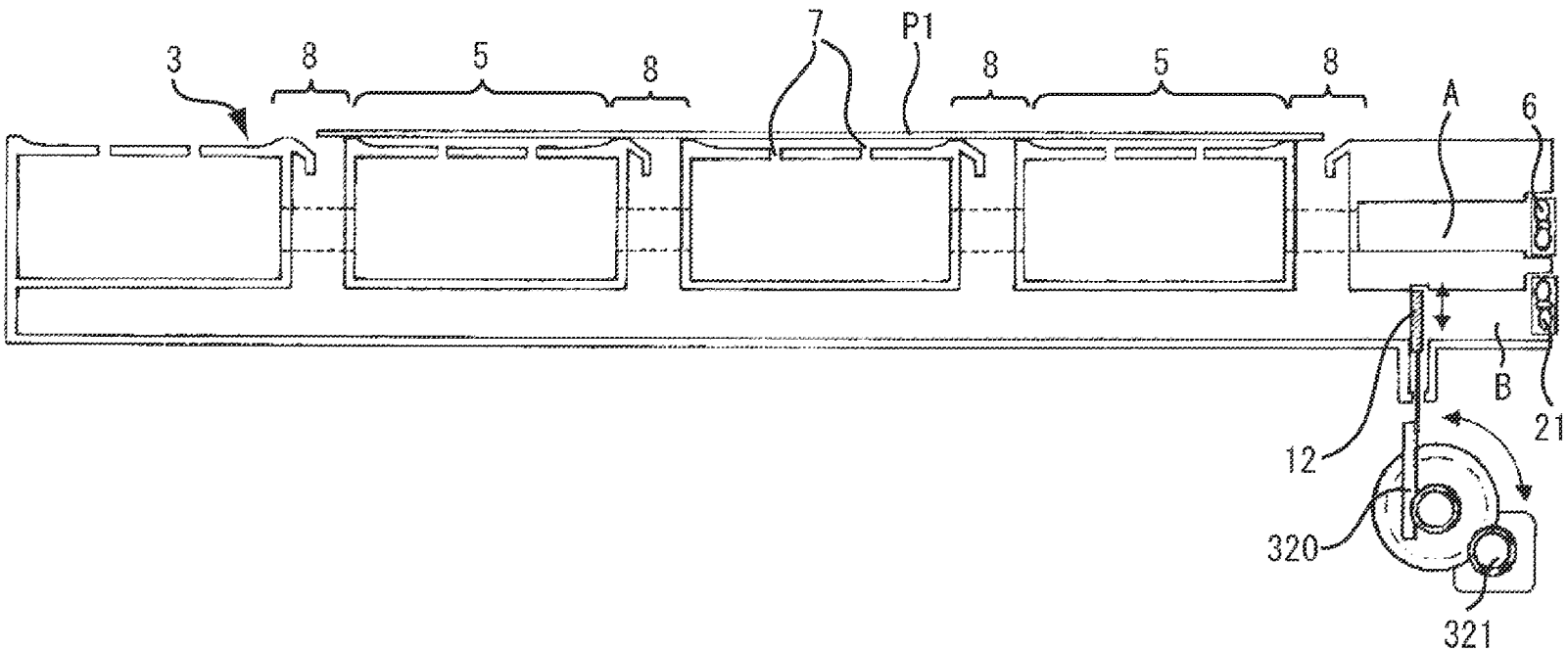
FIG. 11 is a cross-sectional view illustrating a driving mechanism automatically controlling the sectional area of the flow path for ink collection in a platen of the ink-jet recording apparatus of the present invention.

FIG. 11 is a cross-sectional view illustrating a driving mechanism for automatically controlling the sectional area of the collection flow path of the platen in the ink-jet recording apparatus of the present invention. In a structure illustrated in FIG. 11, the shutter unit 12 for varying the sectional area of the collection flow path "B" is driven by a shutter motor 321 via a drive transmission unit (gear row) 320. In this exemplary embodiment, the shutter motor 321 is controlled by feedback according to the type of the recording medium and the image forming time until the above-described image is completed to automatically control the sectional area using the shutter unit 12.

The platen 3 illustrated in FIG. 11 is different from that in FIG. 4 in this point, and otherwise has a similar structure to that in FIG. 4. In the automatic control mechanism of the shutter unit 12 illustrated in FIG. 11, the sectional area of the collection flow path "B" can be automatically varied without bothering a user's hand. Further, by using such an automatic driving mechanism, a setting mistake by the user can be avoided, and the sectional area can be securely and optimally adjusted, thereby improving reliability of the apparatus.

FIG. 11 illustrates the driving mechanism for automatically controlling the sectional area of the collection flow path "B" of the first exemplary embodiment. The sectional area of the collection flow path "C" of the second exemplary embodiment can be also automatically controlled by the similar driving mechanism to that illustrated in FIG. 11. Thus, the description of the automatic control mechanism in FIG. 11 can be also applied to the automatic control mechanism for the collection flow path "C". By adopting such a structure and using the mechanism for automatically controlling the sectional area of the collection flow path "C", similarly, a setting mistake by the user can be avoided, and the sectional area can be securely and optimally adjusted, thereby improving reliability of the apparatus.

Figure 12:
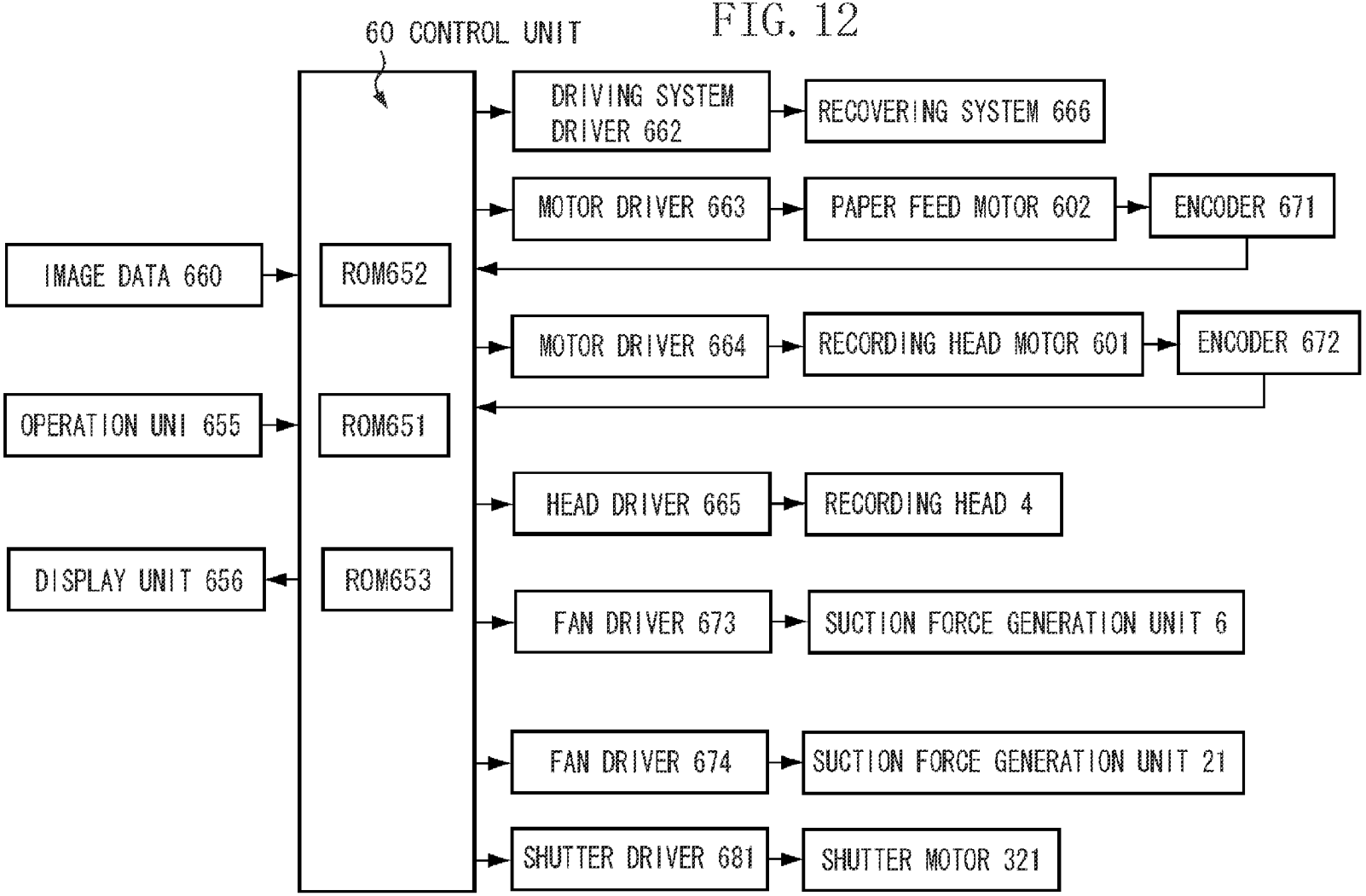
FIG. 12 is a block diagram of a control system in the ink-jet recording apparatus of the present invention.

Next, a control system in the ink-jet recording apparatus of the present invention will be described. FIG. 12 is a block diagram of the control system in the ink-jet recording apparatus of the present invention. A read only memory (ROM) 652 and a random access memory (RAM) 653 are incorporated in a control unit 60 constituting the control system. A central processing unit (CPU) 651 controls various operations of the recording apparatus and an entire apparatus.

The ROM 652 stores a program for performing control and various data in a non-volatile manner. The RAM 653 is used as a storage region for temporarily storing data or a working region to be used for processing by the CPU 651. The control unit 60 includes a head control function for transmitting an image signal containing image information and forwarding the image signal to the recording head 4 to control the ink to be discharged from each jet port.

The recording head 4 is driven when the CPU 651 drives a recording head motor 601 according to a command transmitted to a motor driver 664 based on a control condition. In this case, the recording head motor 601 is driven when a position of the recording head 4 is detected by an encoder 672 and information including a speed and a position is fed back. Further, a timing signal for discharging the ink is generated based on a detection signal of the encoder 672.

The recording head 4 is driven by a recording head motor 601 to move to a position of a recovery system 666 when the discharge port is initially recovered. The recovery system is driven according to a command signal transmitted from the CPU 651 to a recovery system. driver 662. By controlling drive of a recovery system 66 by the recovery system motor, a recovery operation is performed, for example, capping of the recording head 4, a suction recovery movement, and wiping (wiping cleaning) are performed.

Conveyance control for conveying the recording medium is performed by transmitting a control signal according to the image information from the CPU 651 to a motor driver 663 and driving a paper feed motor 602 by a motor driver 663. An encoder 671 detects a state of a conveyance movement and the detection signal is transmitted to the CPU 651, which performs feedback and controls the conveyance movement based on the information.

At this point, in the recording apparatus using a platen suction mechanism as illustrated in FIGS. 4, 5, and 11, the command of the CPU 651 is transmitted to the fan drivers 673 and 674. The suction force generation unit (suction fan) 6 for attracting a recording medium and the suction force generation unit (suction fan) 21 for collecting ink are driven at the number of fan rotations instructed by the CPU 651. By driving the fans, the suction forces are generated at the attraction section 5 and suction collection section 8.

When the flow path control unit including the shutter unit 12 is automatically controlled as illustrated in FIG. 11, the CPU 651 enables a shutter driver 681 to drive the shutter motor 321 based on the control condition. The CPU 651 controls the sectional area (cross-sectional area of the flow path of the collection flow paths "B" and "C") of the flow path control unit 12 to an optimum opening level via the drive transmission mechanism 320. The control unit 60 includes an operation unit 655 for setting various items, a reception unit 660 to which image data is transmitted from a computer, and a display unit 656 for displaying an operation state of the apparatus. The display unit 656 may not be provided in the recording apparatus but may be a display screen of the computer connected to the recording apparatus.

Figure 13:
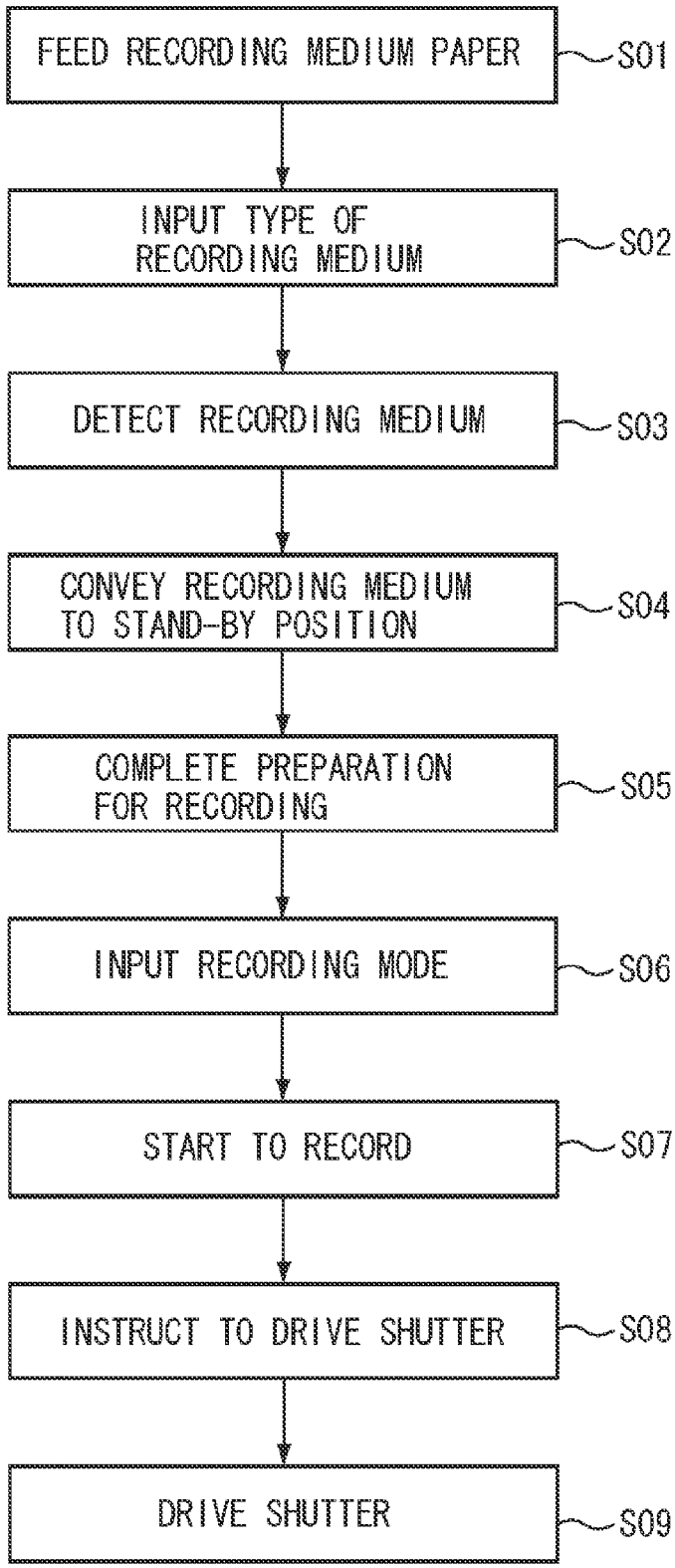
FIG. 13 is a flowchart illustrating an operation by the ink-jet recording apparatus of the present invention.

FIG. 13 is a flowchart illustrating an operation of the ink-jet recording apparatus of the present invention. When a recording operation is started, in step S01, a paper feed operation of the recording medium is performed. When the paper is fed, in step S02, a user selects a type of the recording medium at a display unit (not illustrated) and inputs a signal. After the recording medium is detected in step S03, in step S04, the recording medium is conveyed to a stand-by position. At this point, in step S05, a preparation for recording (image forming) is completed.

In step S06, for example, the user inputs a record mode to the computer, and forwards the data to the recording apparatus. In step S07, recording is started. In step S08, a shutter driving command for driving the flow path control unit 12 is received. In step S09, the flow path control unit (shutter unit) 12 is driven such that the sectional area of the collection flow path "B" (or "C") has an optimum opening. The above-described exemplary embodiments describe a case where the shutter of the flow path control unit 12 has a flat-plate shape, however, the present invention is not limited to the flat-plate shape. For example, the shutter may have a cylindrical shape in which the sectional area can be varied by a rotational movement.

The exemplary embodiments described above can prevent the deterioration of the image quality due to the cockling caused by lacking of the suction force at the suction collection section inside the recording medium. Further, the ink-jet recording apparatus is provided which can prevent the deterioration of the image quality at the end portion of the recording medium caused by the excessive wind velocity at the suction collection section outside the recording medium.

As an example, the above-described exemplary embodiments describe the Ink-jet recording apparatus of a serial type which moves the recording head to perform main scanning. However, the present invention can be similarly applied to the Ink-jet recording apparatus of a line type which uses a full-line recording head and performs recording only by feeding (sub scanning) a sheet. Further, the present invention can be applied to any ink-jet recording apparatus using the platen and to any number of the recording heads, material of any quality and any shape of the recording medium (e.g., rolled paper and cut sheet). Furthermore, the present invention can be applied to any number of attraction sections and suction collection sections on the platen, and any arrangement and any number of suction apertures.

The above-described exemplary embodiments control the flowing amount of the fluid flowing into the suction collection section by using the shutter unit 12. However, the flowing amount of the fluid can be controlled also by controlling the number of the rotations of the suction fan 21 even when the shutter unit is not provided. More specifically, the control unit 60 varies the number of the rotations of the suction fan 21 to change the negative pressure of the collection flow path "B" leading to the suction aperture 9, and thus the flowing amount of the fluid flowing into the suction aperture 9 is varied. In this case, the control unit 60 serves as the flowing amount control unit and also the negative pressure control unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-043547 filed Feb. 26, 2009, which is hereby incorporated by reference herein in its entirety.

What is claimed is:

1. An ink-jet recording apparatus which performs recording by discharging ink from a recording head to a recording medium supported on a platen, comprising:

a collection section which is provided at the platen and configured to collect the ink discharged outside the recording medium;

a suction force generation unit for generating a suction force;

a flow path connecting the collection section to the suction force generation unit for generating a suction force at the collection section; and a flowing amount control unit varying a flowing amount of fluid passing through the flow path.

2. The ink-jet recording apparatus according to claim 1, further comprising:

an attraction section which is provided at the platen and configured to attract and support the recording medium;

a suction force generation unit for attraction configured to enable the attraction section to generate a suction force; and an attraction flow path connecting the attraction section to the suction force generation unit for attraction.

3. The ink-jet recording apparatus according to claim 1, wherein, when the image forming time is long, the suction force of the suction-collection section is set large, and when the image forming time is short, the suction force of the suction-collection section is set small.

4. An ink-jet recording apparatus which performs recording by discharging ink from a recording head to a recording medium supported on a platen, comprising:

a collection section provided at the platen for collecting the ink discharged outside the recording medium;

a suction force generation unit for generating a suction force;

a flow path connecting the collection section to the suction force generation unit for generating a suction force at the collection section; and a flowing amount control unit for varying a flowing amount of fluid passing through the flow path, wherein the flowing amount is varied according to a type of the recording medium.

5. The ink-jet recording apparatus according to claim 4, wherein the type of the recording medium is determined by stiffness and a thickness of the recording medium.

6. The ink-jet recording apparatus according to claim 4, wherein the type of the recording medium is determined by quality of a material applied on the recording medium.

7. The ink-jet recording apparatus according to claim 4, wherein, when the recording medium easily deforms while the image is being formed, the suction force of the suction-collection section is set large, and when the recording medium does not easily deform while the image is being formed, the suction force of the suction-collection section is set small.

8. An ink-jet recording apparatus which performs recording by discharging ink from a recording head to a recording medium supported on a platen, comprising:

a collection section which is provided at the platen and configured to collect the ink discharged outside the recording medium;

a suction force generation unit for generating a suction force;

a flow path connecting the collection section to the suction force generation unit for generating a suction force at the collection section; and a flowing amount control unit for varying a flowing amount of fluid passing through the flow path, wherein the flowing amount is varied according to an image forming time to complete recording.

9. An ink-jet recording apparatus which performs recording by discharging ink from a recording head to a recording medium supported on a platen, comprising:

an attraction section which is provided at the platen and configured to attract the recording medium;

a suction force generation unit for generating a suction force;

a flow path connecting the attraction section to the suction force generation unit for generating a suction force at the attraction section;

a collection section which is provided at the platen and configured to collect the ink discharged outside the recording medium;

a collection flow path connecting the collection section to the flow path; and a flowing amount control unit for varying a flowing amount of fluid passing through the collection flow path, wherein the flowing amount is varied according to an image forming time to complete recording.

10. The ink-jet recording apparatus according to claim 9, wherein the image forming time is determined by a number of times of discharging and superimposing the ink on a certain portion of the recording medium.

11. The ink-jet recording apparatus according to claim 9, wherein the image forming time is determined by a width of the recording medium.

12. An ink-jet recording apparatus which performs recording by discharging ink from a recording head to a recording medium supported on a platen, comprising:

an attraction section which is provided at the platen and configured to attract the recording medium;

a suction force generation unit for generating a suction force;

an attraction flow path connecting the attraction section to the suction force generation unit;

a collection section which is provided at the platen and configured to collect the ink discharged outside the recording medium;

a collection flow path connecting the collection section to the attraction flow path; and a flowing amount control unit for varying a flowing amount of fluid passing through of the collection flow path, wherein the flowing amount is varied according to a type of the recording medium.

13. The ink-jet recording apparatus according to claim 12, wherein the type of the recording medium is determined by stiffness and a thickness of the recording medium.

14. The ink-jet recording apparatus according to claim 12, wherein the type of the recording medium is determined by quality of a material applied on the recording medium.

15. An ink-jet recording apparatus which performs recording by discharging ink from a recording head to a recording medium supported on a platen, comprising:

an attraction section which is provided at the platen and configured to attract the recording medium;

a suction force generation unit for generating a suction force;

an attraction flow path connecting the attraction section to the suction force generation unit;

a collection section which is provided at the platen and configured to collect the ink discharged outside the recording medium;

a collection flow path connecting the collection section to the attraction flow path; and a flowing amount control unit for varying a flowing amount of fluid passing through the collection flow path, wherein the flowing amount is varied according to an image forming time.

16. An ink-jet recording apparatus which performs recording by discharging ink from a recording head to a recording medium supported on a platen, comprising:

a suction aperture which is provided at the platen and configured to suck in and collect the ink discharged outside of the recording medium;

a negative pressure generation unit configured to enable the suction aperture to generate a negative pressure so that fluid can flow in; and a fluid amount control unit configured to vary a flowing amount of the fluid flowing in through the suction aperture according to an image forming time to complete recording.

17. The ink-jet recording apparatus according to claim 16, wherein the fluid amount control unit varies the flowing amount of the fluid flowing in through the suction aperture according to an image forming time.

18. The ink-jet recording apparatus according to claim 16, wherein the fluid amount control unit varies the flowing amount of the fluid flowing in through the suction aperture according to a type of the recording medium.

19. An ink-jet recording apparatus which performs recording by discharging ink from a recording head to a recording medium supported on a platen, comprising:

a suction aperture which is provided at the platen and configured to suck in and collect the ink discharged outside of the recording medium;

a negative pressure generation unit configured to enable the suction aperture to generate a negative pressure so that fluid can flow in; and a negative pressure control unit configured to vary the negative pressure generated by the negative pressure generation unit according to an image forming time to complete recording.

20. The ink-jet recording apparatus according to claim 19, wherein the negative pressure control unit varies the negative pressure generated by the negative pressure generation unit according to an image forming time.

21. The ink-jet recording apparatus according to claim 19, wherein the negative pressure control unit varies the negative pressure generated by the negative pressure generation unit according to a type of the recording medium.

* * * * *